US005711655A

United States Patent [19]

Lundbäck

[11] Patent Number: 5,711,655

[45] Date of Patent: Jan. 27, 1998

[54] PUMP SYSTEM USING A VACUUM CHAMBER AND MECHANICAL PUMP COMBINATIONS

[76] Inventor: Stig Lundbäck, Ostra Tynningö, S-185 00 Vaxholm, Sweden

[21] Appl. No.: 157,138

[22] PCT Filed: Jun. 5, 1992

[86] PCT No.: PCT/SE92/00388

§ 371 Date: Dec. 7, 1993

§ 102(e) Date: Dec. 7, 1993

[87] PCT Pub. No.: WO92/21879

PCT Pub. Date: Dec. 10, 1992

[30] Foreign Application Priority Data

Jun. 7, 1991 [SE] Sweden ..... 9101747

[51] Int. Cl.[6] ..... F04B 23/08

[52] U.S. Cl. ..... 417/85; 417/148

[58] Field of Search ..... 417/118, 119, 417/148, 297.5, 85, 149

[56] References Cited

U.S. PATENT DOCUMENTS

| | | | |
|---|---|---|---|
| 3,342,135 | 9/1967 | Schnabel, Jr. | 417/85 |
| 4,147,474 | 4/1979 | Heimdal | 417/148 |
| 4,339,232 | 7/1982 | Campbell | 417/148 |
| 4,514,977 | 5/1985 | Bowen | 417/148 |
| 4,736,749 | 4/1988 | Lundback | 128/643 |
| 4,896,548 | 1/1990 | Lalin et al. | 73/864.34 |
| 5,325,667 | 7/1994 | Lundback | 60/398 |

FOREIGN PATENT DOCUMENTS

| | | | |
|---|---|---|---|
| 0374115 | 6/1990 | European Pat. Off. . | |
| 3229528 | 9/1984 | Germany . | |
| 2146704 | 4/1985 | United Kingdom | 417/148 |

*Primary Examiner*—Timothy Thorpe
*Assistant Examiner*—Peter G. Korytnyk

[57] ABSTRACT

A pump arrangement having a mechanical pump in series with a vacuum compartment on an inlet side of the mechanical pump. The vacuum compartment has a suction line flow connected to the supply of liquid to be pumped and draws that liquid by vacuum to the inlet of the mechanical pump. The mechanical pump includes an outlet for delivering the liquid to be pumped.

23 Claims, 2 Drawing Sheets

PUMP SYSTEM USING A VACUUM CHAMBER AND MECHANICAL PUMP COMBINATIONS

BACKGROUND OF THE INVENTION

The invention relates to a pump arrangement for transporting a liquid from a first location by means of a pump positioned at a second location which may be at a higher level than the first location. The invention also relates to a method for such pumping.

A commonly occurring problem is to pump liquid from a lower level to a higher level in a situation in which the liquid to be pumped is not easily accessible to permit a pump of the required lifting capacity to be positioned with its inlet located near the level from which the liquid is to be drawn. In situations like that, an immersible pump is normally used, but such a solution is not always satisfactory.

An object of the invention is to provide a simple and efficient pump arrangement which offers a good solution to the problem, and a simple and efficient method for pumping operations of the kind indicated.

These and other objects of the invention are achieved with a pump arrangement and a method as defined in the claims.

The invention is described in greater detail below with reference to the annexed drawings.

DETAILED DESCRIPTION OF THE PREFERRED EMBODIMENTS

Figure 1:
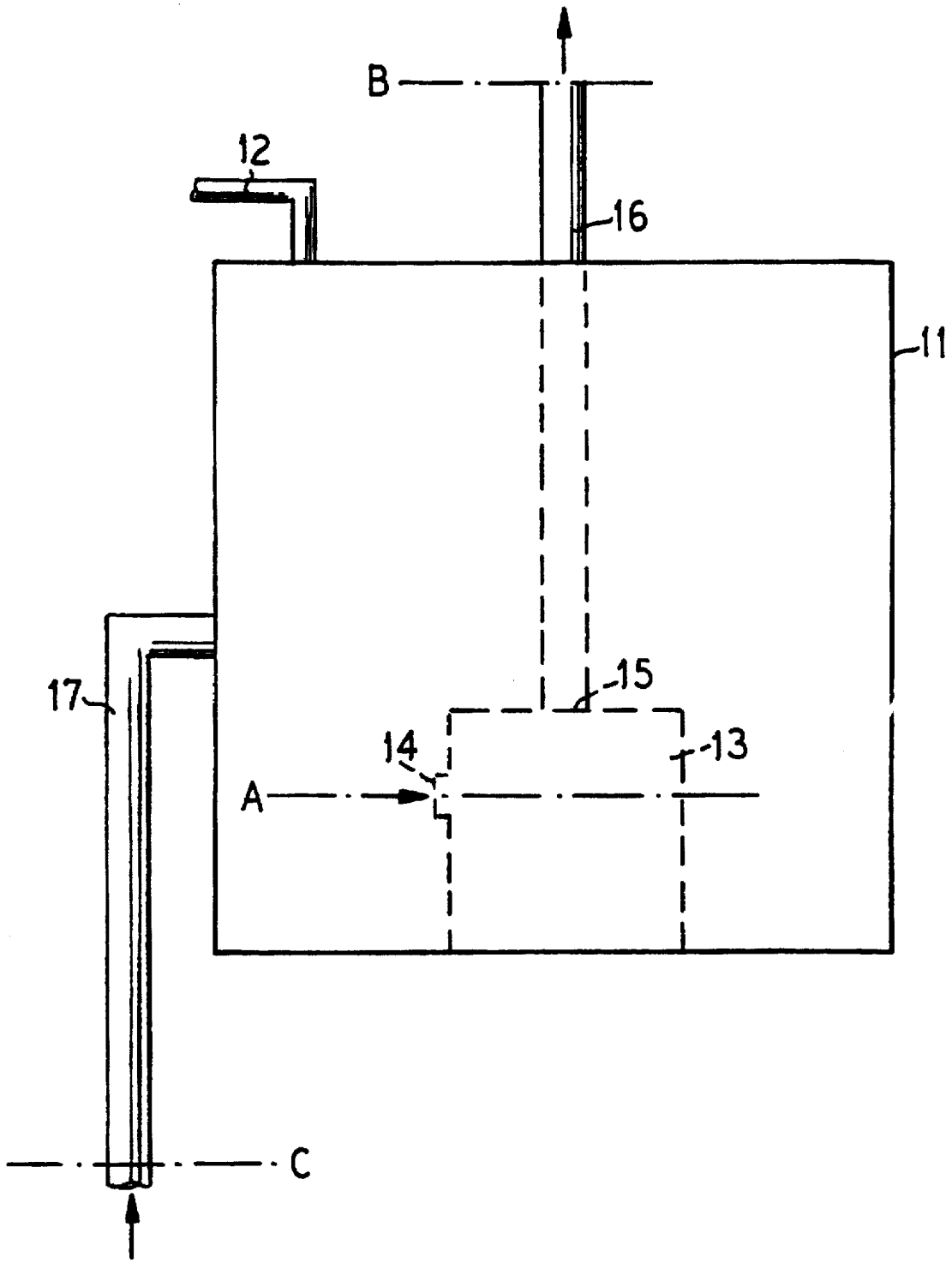
FIG. 1 is a schematic illustration of the basic features of the invention.

In FIG. 1, numeral 11 designates a hermetically sealed vacuum compartment which is kept under negative pressure through a conduit 12 connected to a suction pump or other suitable vacuum source. The vacuum compartment 11 houses a pump 13 the inlet 14 of which is always in communication with the interior of the vacuum compartment at a level A and the outlet 15 of which is in communication with the surrounding space by way of an outlet conduit 16.

The pump 13 is a pressure pump, that is, a pump that pressurizes the pumped fluid to the degree required for lifting the liquid to the desired level which is designated by B in FIG. 1. Basically, any pressure pump may be used, such as a positive-displacement pump (piston pump) or a centrifugal pump.

Connected to the vacuum compartment 11 is also one end of a suction conduit 17. The other end of the conduit 17, which may be a pipe or a hose capable of resisting the occurring negative pressure without collapsing, is intended during the pumping operation to be immersed in the liquid to be pumped; the level of that liquid is indicated at C in FIG. 1.

In this case, level A is presumed to be higher than level C and lower than level B but this vertical relationship is not necessary in all cases. For example, level B may well be lower than level A.

In operation of the pump arrangement, liquid is lifted through the suction conduit 17 to the interior of the vacuum compartment 11 under the influence of the negative pressure in that compartment. When the liquid in the vacuum compartment reaches the inlet level A, the pump 13 carries the inflowing liquid away through the outlet conduit 16.

The vacuum compartment 11 may be provided with a level control or level monitoring device (not shown) which ensures that the liquid level in the vacuum compartment never drops below the pump inlet level A. However, as will become apparent from the following description, such a device can be dispensed with if the pump is of the inflow-controlled type and provided with a valve which prevents backflow through the pump.

As long as the liquid is being pumped out of the vacuum compartment 11 and flows into the compartment at the same rates, no air has to be pumped out of the vacuum compartment to maintain the required negative pressure, provided of course that no air leaks into the compartment.

Obviously, the pump has to operate against the negative pressure, but this does not mean any loss of energy, because basically no energy is consumed for maintaining the negative pressure and the energy consumption which is caused by the pump having to operate against the negative pressure is balanced by the gain of energy resulting from the pump lifting from level A instead of lifting from level C.

Figure 2:
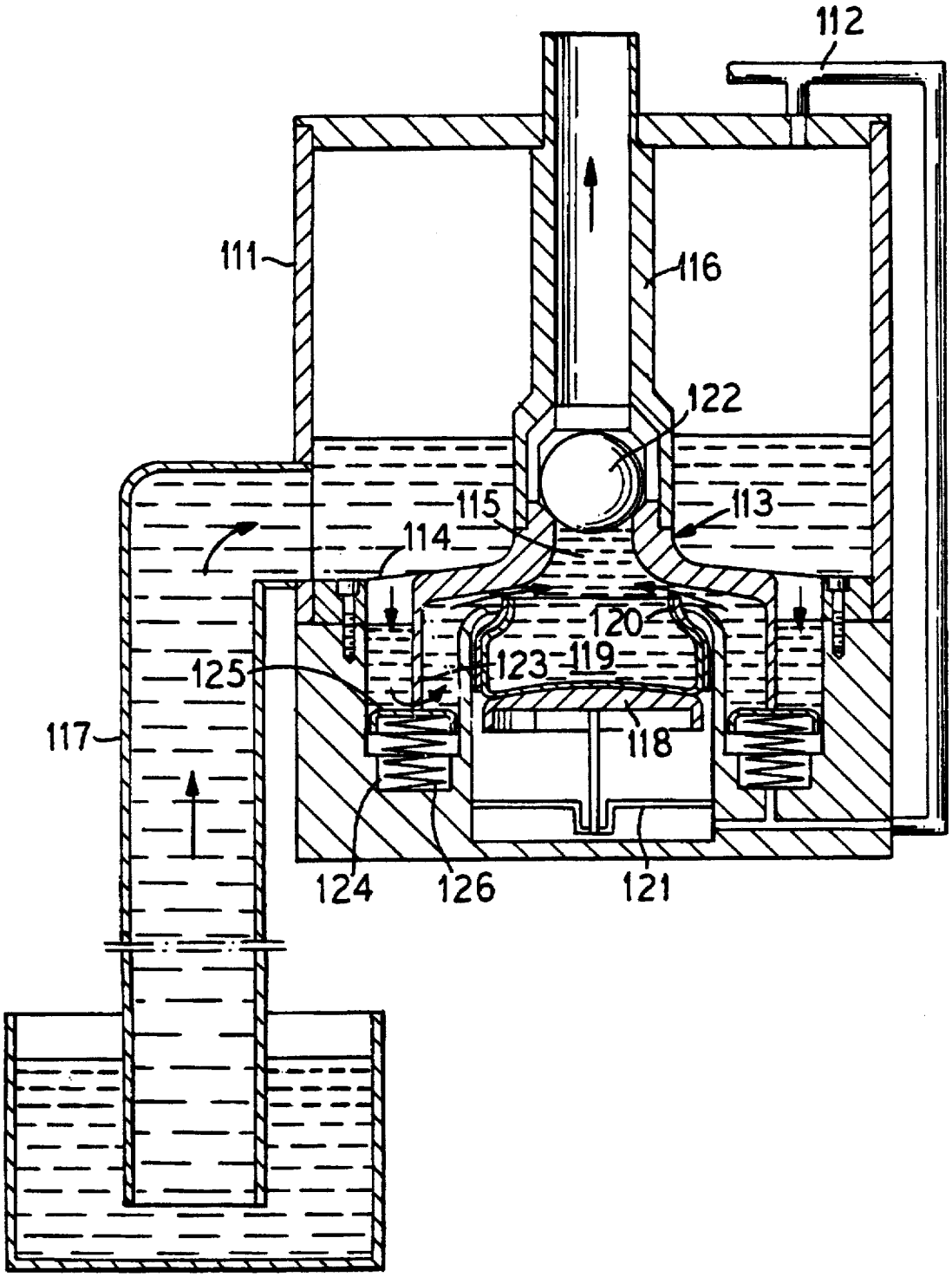
FIG. 2 is likewise a schematic illustration in vertical section of a pump arrangement embodying the invention.

In FIG. 2, the main components of the pump arrangement have the same reference numerals as in FIG. 1 with the addition of the digit 1 as a prefix.

In this case, pump 113 is an inflow-controlled pump of the type known from EP-A-0 374 115, that is, its discharge flow rate is determined, within the limits set by the capacity of the pump, by the rate of inflow. Accordingly, the pump is a positive-displacement pump having a piston 118 operating in a pump chamber 119 into which the inflow takes place by way of an inlet valve 120, which is a one-way valve and provided in an inlet gap extending around the pump chamber.

The pump piston 118 is driven positively at least in the displacement direction (upwardly) by a suitable drive which is symbolised by a crankshaft 121 in the figure but which needs not necessarily comprise such an element.

The pump piston 118 is arranged such that it does not produce any suction in the pump chamber 119 during its downward movement, so that the pump chamber is expanded and filled solely by the inflow in the manner described in the just-mentioned publication.

Adjacent the pump outlet 115, a one way valve 122 is provided which prevents backflow through the pump.

At the pump inlet 114 a water seal 123 is provided, and at the bottom of this water seal there is a liquid compartment, herein termed accumulating compartment, which is limited upwardly by a vertically movable wall 125 supported by a soft compression spring 126. The accumulating compartment 124 serves during those phases of the pump cycle in which the inlet valve 120 is closed to allow liquid to continue to flow through the pump inlet 114 essentially as during the open phases. The accumulating compartment is then expanded while compressing the spring 126. Upon opening of the inlet valve 120, the energy stored in the spring is utilised to feed the accumulated liquid volume into the pump chamber 119 together with the continuous, substantially constant inflow from the pump inlet 114.

The supply of the accumulated volume speeds up the filling of the pump chamber 119 without affecting the inflow from the pump inlet, because the gap-like inlet passage opened by the inlet valve 120 is large enough for the inflow into the pump chamber to take place without any appreciable pressure drop.

As is apparent from FIG. 2, the side of the movable wall 125 of the accumulating compartment which faces away from the pump inlet 114, and the side of the pump piston 118 facing away from the pump chamber 119 are subjected to the negative pressure existing inside the vacuum compartment 111. This negative pressure is communicated by way of branches of the vacuum conduit 112. Accordingly, the positioning of the pump in the vacuum compartment 111 has no consequence to the pump apart from the fact that the pump piston has to operate against the negative pressure during the pumping operation.

The invention claimed is:

1. A pump arrangement for transporting liquid from a first location by means of a pump positioned at a second location, comprising a pump having a pump inlet, a pump outlet, and pressure pump means for expelling liquid supplied by way of the pump inlet through the pump outlet, a hermetically sealed vacuum compartment, means for maintaining a negative pressure in the vacuum compartment, a suction conduit for lifting liquid from a suction opening of said suction conduit at a hydraulic elevation below said pump inlet into the vacuum compartment which conduit is flow connected to the interior of the vacuum compartment, and means for connecting the pump inlet to the interior of the vacuum compartment with the pump outlet connected to an outlet conduit opening outside the vacuum compartment wherein said outlet conduit is located entirely above said suction opening of said suction conduit.

2. A pump arrangement according to claim 1, wherein the vacuum compartment is adapted to enclose the entire pump with the pump outlet opening outside the vacuum compartment by way of an outlet conduit extending out of the vacuum compartment.

3. A pump arrangement according to claim 1 or 2, wherein the vacuum compartment includes means for maintaining a liquid level therein which is at or above the uppermost portion of the pump inlet.

4. A pump arrangement according to claim 3, wherein the pump is an inflow-controlled pump.

5. A pump arrangement according to any one of claims 1–2, wherein the pump is an inflow-controlled pump.

6. A pump arrangement according to any one of claim 1, wherein the pump inlet is in communication with the pump means by way of a water seal.

7. A pump arrangement according to any one of claim 1, further comprising an accumulating compartment which is in open communication with the pump inlet and whose volume is variable in dependence on the inflow of liquid to the pump inlet.

8. A pump arrangement according to claim 7, wherein the accumulating compartment is expandable by displacement of a compartment-defining movable wall against the influence of a load acting on the wall.

9. A pump arrangement for transporting liquid from a first location by means of a pump positioned at a second location, comprising a pump having a pump inlet, a pump outlet, and pressure pump means for expelling liquid supplied by way of the pump inlet through the pump outlet, a hermetically sealed vacuum compartment, means for maintaining a negative pressure in the vacuum compartment, a suction conduit for lifting liquid into the vacuum compartment which conduit is flow connected to the interior of the vacuum compartment, and means for connecting the pump inlet to the interior of the vacuum compartment with the pump outlet opening outside the vacuum compartment, wherein the pump inlet is in communication with the pump means by way of a water seal.

10. A pump arrangement according to any one of claim 9, further comprising an accumulating compartment which is in open communication with the pump inlet and whose volume is variable in dependence on the inflow of liquid to the pump inlet.

11. A pump arrangement according to claim 9, wherein the vacuum compartment is adapted to enclose the entire pump with the pump outlet opening outside the vacuum compartment by way of an outlet conduit extending out of the vacuum compartment.

12. A pump arrangement for transporting liquid from a first location by means of a pump positioned at a second location, comprising a pump having a pump inlet, a pump outlet, and pressure pump means for expelling liquid supplied by way of the pump inlet through the pump outlet, a hermetically sealed vacuum compartment, means for maintaining a negative pressure in the vacuum compartment, a suction conduit for lifting liquid into the vacuum compartment which conduit is flow connected to the interior of the vacuum compartment, and means for connecting the pump inlet to the interior of the vacuum compartment with the pump outlet opening outside the vacuum compartment, further comprising an accumulating compartment which is in open communication with the pump inlet and whose volume is variable in dependence on the inflow of liquid to the pump inlet.

13. A pump arrangement according to claim 12, wherein the accumulating compartment is expandable by displacement of a compartment-defining movable wall against the influence of a load acting on the wall.

14. A pump arrangement according to claim 12, wherein the vacuum compartment is adapted to enclose the entire pump with the pump outlet opening outside the vacuum compartment by way of an outlet conduit extending out of the vacuum compartment.

15. A pump arrangement for transporting liquid from a first location by means of a pump positioned at a second location, comprising a pump having a pump inlet, a pump outlet, and pressure pump, means for expelling liquid supplied by way of the pump inlet through the pump outlet, a hermetically sealed vacuum compartment, means for maintaining a negative pressure in the vacuum compartment, a suction conduit for lifting liquid into the vacuum compartment which conduit is flow connected to the interior of the vacuum compartment, and means for connecting the pump inlet to the interior of the vacuum compartment with the pump outlet opening outside the vacuum compartment, wherein the vacuum compartment includes means for maintaining a liquid level therein which is at or above the uppermost portion of the pump inlet, wherein the pump inlet is in communication with the pump means by way of a water seal.

16. A pump arrangement according to claim 15, wherein the vacuum compartment is adapted to enclose the entire pump with the pump outlet opening outside the vacuum compartment by way of an outlet conduit extending out of the vacuum compartment.

17. A pump arrangement for transporting liquid from a first location by means of a pump positioned at a second location, comprising a pump having a pump inlet, a pump outlet, and pressure pump means for expelling liquid supplied by way of the pump inlet through the pump outlet, a hermetically sealed vacuum compartment, means for maintaining a negative pressure in the vacuum compartment, a suction conduit for lifting liquid into the vacuum compartment which conduit is flow connected to the interior of the vacuum compartment, and means for connecting the pump inlet to the interior of the vacuum compartment with the pump outlet opening outside the vacuum compartment, wherein the pump is an inflow-controlled pump, wherein the pump inlet is in communication with the pump means by way of a water seal.

18. A pump arrangement according to claim 17, wherein the vacuum compartment is adapted to enclose the entire pump with the pump outlet opening outside the vacuum compartment by way of an outlet conduit extending out of the vacuum compartment.

19. A pump arrangement for transporting liquid from a first location by means of a pump positioned at a second location, comprising a pump having a pump inlet, a pump outlet, and pressure pump means for expelling liquid supplied by way of the pump inlet through the pump outlet, a hermetically sealed vacuum compartment, means for maintaining a negative pressure in the vacuum compartment, a suction conduit for lifting liquid into the vacuum compartment which conduit is flow connected to the interior of the vacuum compartment, and means for connecting the pump inlet to the interior of the vacuum compartment with the pump outlet opening outside the vacuum compartment, wherein the vacuum compartment includes means for maintaining a liquid level therein which is at or above the uppermost portion of the pump inlet, further comprising an accumulating compartment which is in open communication with the pump inlet and whose volume is variable in dependence on the inflow of liquid to the pump inlet.

20. A pump arrangement according to claim 19, wherein the vacuum compartment is adapted to enclose the entire pump with the pump outlet opening outside the vacuum compartment by way of an outlet conduit extending out of the vacuum compartment.

21. A pump arrangement for transporting liquid from a first location by means of a pump positioned at a second location, comprising a pump having a pump inlet, a pump outlet, and pressure pump means for expelling liquid supplied by way of the pump inlet through the pump outlet, a hermetically sealed vacuum compartment, means for maintaining a negative pressure in the vacuum compartment, a suction conduit for lifting liquid into the vacuum compartment which conduit is flow connected to the interior of the vacuum compartment, and means for connecting the pump inlet to the interior of the vacuum compartment with the pump outlet opening outside the vacuum compartment, wherein the pump is an inflow-controlled pump, further comprising an accumulating compartment which is in open communication with the pump inlet and whose volume is variable in dependence on the inflow of liquid to the pump inlet.

22. A pump arrangement according to claim 21, wherein the vacuum compartment is adapted to enclose the entire pump with the pump outlet opening outside the vacuum compartment by way of an outlet conduit extending out of the vacuum compartment.

23. A pump arrangement for transporting liquid from a first location by means of a pump positioned at a second location, comprising a pump having a pump inlet, a pump outlet, and pressure pump means for expelling liquid supplied by way of the pump inlet through the pump outlet;

a hermetically sealed vacuum compartment;

means for maintaining a negative pressure in the vacuum compartment;

a suction conduit for lifting liquid into the vacuum compartment which conduit is flow connected to the interior of the vacuum compartment; and means for connecting the pump inlet to the interior of the vacuum compartment with the pump outlet opening outside the vacuum compartment;

wherein the vacuum compartment is adapted to enclose the entire pump with the pump outlet opening outside the vacuum compartment by way of an outlet conduit extending out of the vacuum compartment;

wherein the vacuum compartment includes means for maintaining a liquid level therein which is at or above the uppermost portion of the pump inlet;

wherein the pump inlet is in communication with the pump means by way of a water seal;

further comprising an accumulating compartment which is in open communication with the pump inlet and whose volume is variable in dependence on the inflow of liquid to the pump inlet; and wherein the accumulating compartment is expandable by displacement of a compartment-defining movable wall against the influence of a load acting on the wall.

* * * * *